US008801233B2

(12) United States Patent
Lu

(10) Patent No.: US 8,801,233 B2
(45) Date of Patent: Aug. 12, 2014

(54) OPTICAL ARRANGEMENT FOR A SOLID-STATE LIGHTING SYSTEM

(75) Inventor: Dong Lu, Cary, NC (US)

(73) Assignee: Cree, Inc., Durham, NC (US)

( * ) Notice: Subject to any disclaimer, the term of this patent is extended or adjusted under 35 U.S.C. 154(b) by 286 days.

(21) Appl. No.: 13/307,444

(22) Filed: Nov. 30, 2011

(65) Prior Publication Data

US 2013/0134456 A1 May 30, 2013

(51) Int. Cl.
*F21V 3/00* (2006.01)
*F21V 5/00* (2006.01)

(52) U.S. Cl.
USPC ..... 362/311.02; 362/249.02; 362/800

(58) Field of Classification Search
USPC ..... 362/249.02, 311.02, 800
See application file for complete search history.

(56) References Cited

U.S. PATENT DOCUMENTS

| | | | |
|---|---|---|---|
| 6,543,911 | B1 | 4/2003 | Rizkin et al. |
| 7,213,940 | B1 | 5/2007 | Van De Ven et al. |
| 2004/0228131 | A1 | 11/2004 | Minano et al. |
| 2006/0291206 | A1 | 12/2006 | Angelini et al. |
| 2007/0268694 | A1 | 11/2007 | Bailey et al. |
| 2011/0182065 | A1 | 7/2011 | Negley et al. |
| 2011/0273882 | A1 | 11/2011 | Pickard |

FOREIGN PATENT DOCUMENTS

| | | | |
|---|---|---|---|
| EP | 2199661 | A2 | 6/2012 |
| WO | WO 2009036001 | A1 * | 3/2009 |
| WO | 2011094122 | A2 | 8/2011 |

OTHER PUBLICATIONS

Cree, Inc., International Application No. PCT/US2012/033427, International Search Report and Written Opinion, Jun. 13, 2012.
Cree, Inc., International Application No. PCT/US2012/066179, International Search Report and Written Opinion, Apr. 16, 2013.
Lu, Dong, U.S. Appl. No. 13/093,085, filed Apr. 25, 2011.

* cited by examiner

*Primary Examiner* — Jason Moon Han
(74) *Attorney, Agent, or Firm* — Dennis J. Williamson; Moore & Van Allen PLLC

(57) ABSTRACT

An optical arrangement and a solid-state lighting system comprise an optical element having at least one lens where the lens has a faceted surface defining a plurality of facets. An LED light source comprises a plurality of LED chips and is arranged relative to the faceted surface such that the plurality of facets are disposed asymmetrically relative to the plurality of chips such that mixing of light from the plurality of LED chips occurs via the surface.

24 Claims, 7 Drawing Sheets

OPTICAL ARRANGEMENT FOR A SOLID-STATE LIGHTING SYSTEM

BACKGROUND

Light emitting diode (LED) lighting systems and light fixtures are becoming more prevalent and may be used as replacements for existing lighting systems and light fixtures. LEDs are an example of solid state lighting and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies or chips are mounted within an LED package or an LED module, which may make up part of a lighting fixture which includes one or more power supplies to power the LEDs. Some lighting fixtures include multiple LED modules. A module may include, for example, a packaging material with metal leads (to the LED dies from outside circuits), a protective housing for the LED dies, a heat sink, or a combination of such elements. An LED fixture may be made using the LED modules with a form factor that allows it to be used as a bulb, lamp or the like to replace a standard threaded incandescent bulb, fluorescent or halogen lamps or the like. LED fixtures may include some type of optical elements external to the LED modules themselves.

SUMMARY

An optical arrangement for a solid-state lighting system comprises an optical element comprising at least one lens, the lens having a faceted surface defining a plurality of facets. An LED light source comprises a plurality of LED chips and is arranged relative to the faceted surface such that the plurality of facets are disposed asymmetrically relative to the plurality of chips such that light from the plurality of LED chips is mixed by the faceted surface.

The optical element may comprise a TIR optical element. The LED light source may comprise four LED chips. The faceted surface may comprise six facets. At least one of the plurality of LED chips may comprise a red-emitting LED. At least one of the plurality of LED chips may comprise a blue-shifted yellow LED device. The blue-shifted yellow LED device may be packaged with a local phosphor. The blue-shifted yellow LED device plus the red-emitting LED may create substantially white light. A plurality of LED light sources may be provided where the TIR optical element comprises a plurality of lenses where each one of the plurality of lenses corresponds to one of the plurality of LED light sources. An exit surface may comprise a flat substrate with a microlens. An entrance surface may be associated with the at least one lens where the entrance surface comprises a second plurality of facets. The facets may be planar surfaces. A first light from one of the plurality of LED chips may pass through one of the plurality of facets and a second light from another one of the plurality of LED chips may pass through the same facet. The first light may be a first color and the second light may be a second color. A first amount of the first light may pass through a facet and a second amount of the second light may pass through the same facet where the first amount is less than the second amount. The LED light source may comprise a plurality of light sources arranged in an array where each of said light sources comprises a plurality of LED chips wherein the plurality of LED chips comprises a first type of chip for emitting a first color light and a second type of chip for emitting a second color of light. A plurality of lenses may be provided where one of the plurality of lenses corresponds to each one of the plurality of light sources. An LED lamp comprising the optical element is also provided. A connector of a standard, MR-16 lamp may be provided. An interior surface of the optical element that surrounds the LED light source may be faceted.

An LED lighting system comprises an optical element having at least one lens, the lens having a faceted entrance surface defining a plurality of facets. An LED light source comprises a plurality of LED chips, the LED light source being arranged relative to the faceted surface such that the plurality of facets are disposed asymmetrically relative to the plurality of LED chips such that light from the plurality of LED chips is mixed.

A method of assembling a lighting system comprises arranging a plurality of LED light sources in an array within a housing where each light source comprises a plurality of LED chips; placing at least one optical element to receive and direct light from the plurality of LED light sources where the optical element comprises a plurality of lenses and each of the plurality of lenses having a faceted surface defining a plurality of facets; and arranging the at least one optical element relative to the array such that the plurality of facets of each of the plurality of lenses are disposed asymmetrically relative to the plurality of LED chips of each of the plurality of LED light sources.

DETAILED DESCRIPTION

Figure 1:
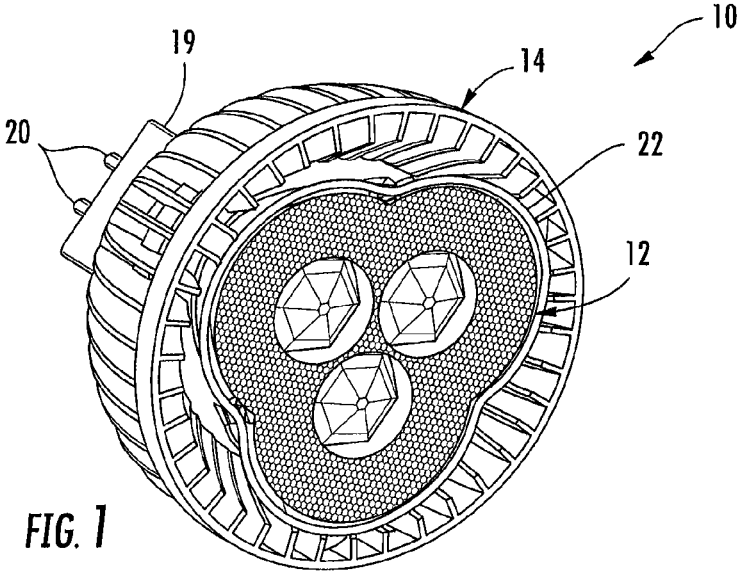
FIG. 1 is a perspective view of an LED lighting system according to example embodiments of the invention.
Figure 3:
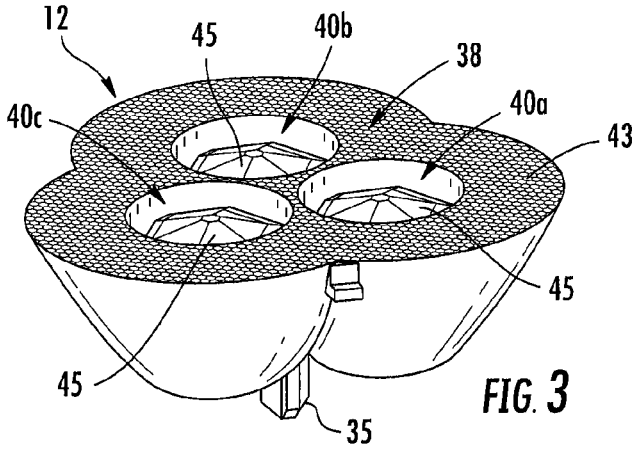
FIG. 3 is a perspective view of the TIR optical element of the LED lighting system of FIG. 1.
Figure 4:
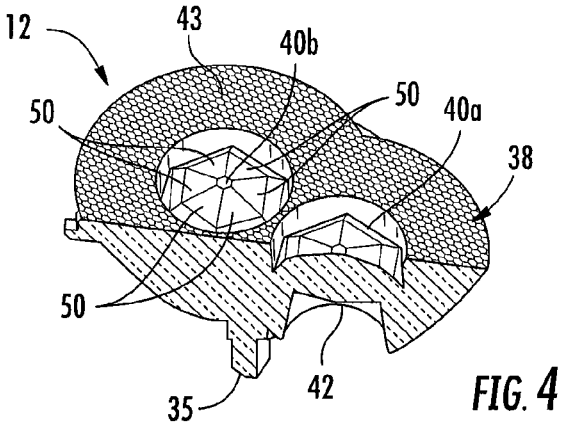
FIG. 4 is a perspective section view of the TIR optical element of FIG. 3.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

An optical element that exhibits total internal reflection (TIR), a "TIR optic" or "TIR optical element," may be used in solid-state lighting systems that require directional focus or collimation. A TIR optical element is essentially a lens made of transparent material such as polycarbonate, acrylic, glass or the like designed in such a way that light, once having entered into the transparent media, encounters the side walls of the lens at angles greater than the critical angle, resulting in total internal reflection. Thus, a TIR optic can also serve as a reflector. Typical TIR optical elements include one or more entry surfaces, one or more exit surfaces, and a sidewall or outer surface that internally reflects light. The sidewall is shaped so that light rays hitting at various angles on the sidewall reflect at an angle greater than the critical angle. A TIR optic outer surface may have various shapes including conic, angled, arced, spherical, curved as well as segmented shapes.

Shown herein are example embodiments of LED solid-state replacement lamps using an optical arrangement as described above. These detailed embodiments are provided as examples only and a lighting fixture, luminaire, lighting system, bulb or lamp that implements an embodiment of the invention can take many forms and be made in many ways. An embodiment of the invention can be developed based on the disclosure herein for many types of directional solid-state lighting.

Figure 2:
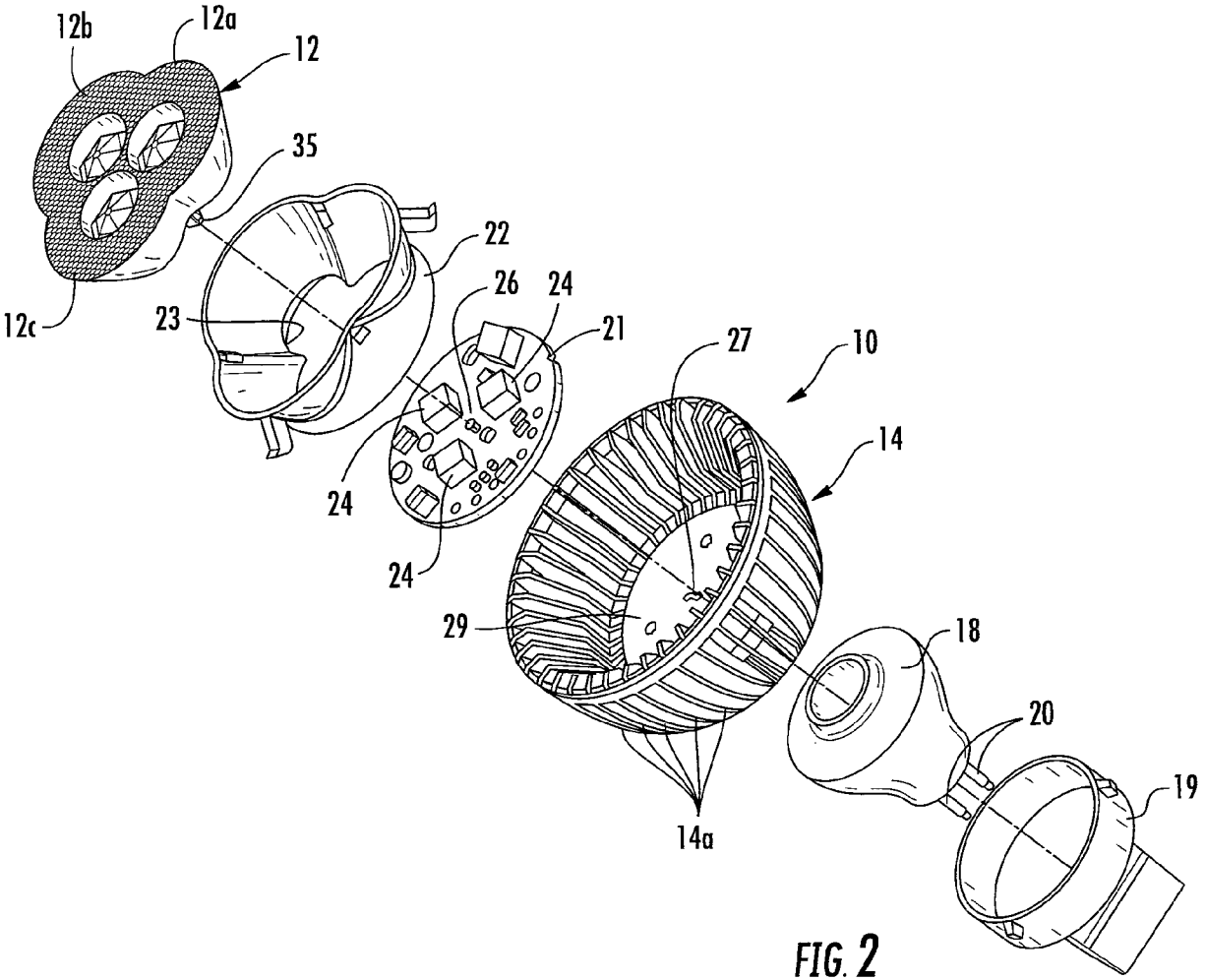
FIG. 2 is an exploded view of the major components of the LED lighting system of FIG. 1.
Figure 5:
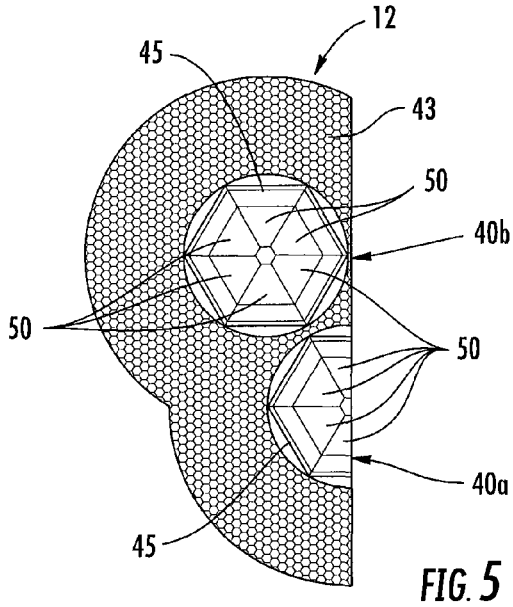
FIG. 5 is a top view corresponding to the perspective section view of the TIR optical element of FIG. 4.

Referring to FIGS. 1 and 2 an embodiment of an LED-based, solid-state replacement for a standard, MR16 halogen lamp is shown. Solid state lamp 10 includes TIR optical element 12, which has three lobes 12*a*, 12*b*, 12*c*. Each lobe corresponds to an LED light source 24 and each light source in this example embodiment includes four LED chips. Lamp 10 also includes a heat sink 14 that may be made of aluminum or other thermally conductive material and may comprise a plurality of fins 14*a* for dissipating heat to the ambient environment.

A power supply 18 is provided that includes electrical components to provide the proper voltage and current to the LED light sources 24 within lamp 10. The power supply 18 may be contained in a housing that is connected to the heat sink 14. Connection pins 20 provide a standard connection to power rails, which may be AC or DC supply rails. The lamp may also be used as a solid-state replacement for a standard, PAR type incandescent bulb. In such an application the lamp would include an Edison type base in place of pins 20. Other connectors may be used to provide power to the lamp in other applications A diffuse, white, highly reflective secondary reflector 22 may be provided within the heat sink structure 14 of lamp 10, so that the secondary reflector is substantially adjacent to but spaced a small airgap apart from the sidewalls of TIR optical element 12. Secondary reflector 22 is molded or thermoformed into the desired shape to fit together with the heat sink portion of the lamp and TIR optical element 12. The secondary reflector can be made of many different materials, including materials that are made reflective by application of a powder coating, reflective paint, or the like. The air gap between the TIR optical element 12 and the highly reflective secondary reflector serves to insure that the internal reflectivity of the optical element is not interfered with by the secondary reflector. However, light that escapes by transmission from the TIR optical element 12 is efficiently reflected back into the TIR optical element for another opportunity to eventually be transmitted or reflected from the exit surface 38 of the optical element.

Figure 12:
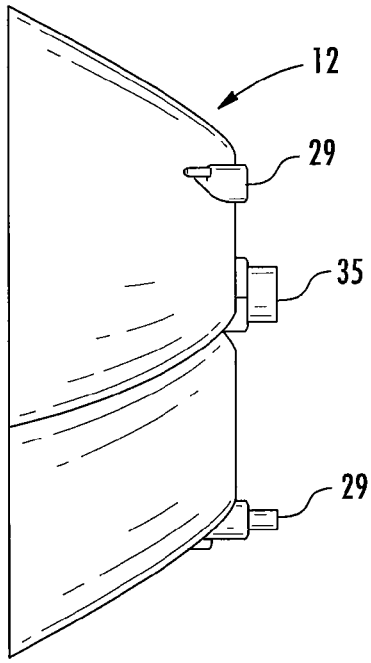
FIG. 12 is a side view of an alternate embodiment of a TIP optical element.

A mounting surface 21 is provided inside the lamp 10 for mounting the LED light sources 24. In the illustrated embodiment three LED light sources 24 are arranged in an array so that each light source corresponds to a lobe 12*a*, 12*b*, and 12*c* of the optical element 12. A recess or slot 26 is provided in the mounting surface 21 and a corresponding recess or slot 27 is formed in the base 29 of heat sink 14. The slots 26 and 27 are aligned when the mounting surface 21 is mounted to the base of the heat sink 14. The recesses or slots 26 and 27 receive a mating projection 35 formed on the optical element 12 to seat the TIR optical element 12, for aligning the LED light sources 24 and the TIR optical element 12. Alternatively, a plurality of projections 29 may be provided, for example around the periphery of the optical element 12, that engage a plurality of mating recesses or slots formed on the mounting surface 21 and/or heat sink 14 as shown in FIG. 12. Secondary reflector 22 includes a hole or holes 23 through which light passes from LED light sources 24 into the TIR optical element 12, and through which the projection passes so that the projections 29 and/or 35 can seat properly with the recesses of the mounting surface 21 and/or the heat sink 14. A retention ring, not shown, may be used to clamp the various portions of the lamp together and hold the optical element 12 in the housing.

Various arrangements and types of LED light sources 24 emitting various colors of light can be used with embodiments of the invention. The embodiment of the LED light source 24 shown in FIG. 7 comprises four LED chips or dies (hereinafter "chips") 31*a*, 31*b*, 31*c* and 31*d* packaged on a submount or mounting surface 21 with a lens (not shown). At least one of the LED chips, for example LED chip 31*a*, may be a red-emitting LED, and at least one of other LED chips, for example LED chip 31*b*, may be a blue-shifted yellow LED device. The blue-shifted yellow LED device may be packaged with a local phosphor to form blue-shifted yellow LED devices. Such a blue-shifted yellow plus red (BSY+R) system is used to create substantially white light. In some embodiments, the red LEDs, when illuminated, emit light having dominant wavelength from 605 to 630 nm. In some embodiments, the LED chips for the BSY devices emit blue light having a dominant wavelength from 440 to 480 nm. The phosphor packaged with the blue LEDs when excited by the impinging blue light, may emit light having a dominant wavelength from 560 to 580 nm. This is but one example of light sources that can be used with embodiments of the present invention. Various numbers and types of LEDs can be combined. Further examples and details of mixing colors of light using solid state emitters can be found in U.S. Pat. No. 7,213,940, which is incorporated herein by reference. In one embodiment, as shown in FIGS. 8A-8D, three LED light sources 24 may be used where each light source 24 includes four LED chips 31*a*-31*d* where the red-emitting LED chip is shown as shaded and the BSY LED device is shown unshaded. The LED chips are arranged such that between the three LED light sources 24 a red-emitting LED chip is located in each of the four quadrants. In other words if the three LED light sources 24 were overlayed on top of one another a red-emitting LED chip would be located in each quadrant.

In the illustrated embodiment, the TIR optical element 12 is shown with three lobes 12*a*, 12*b*, 12*c* where each lobe corresponds to an LED light source 24 and each light source 24 in this example embodiment includes four LED chips 31*a*-31*d*. The TIR optical element 12 has an exit surface 38 that comprises a first portion 43 that comprises a flat substrate with a microlens for diffusing light and a second portion that comprises discrete lenses 40*a*, 40*b* and 40*c* arranged in a one to one relationship with the LED light sources 24. The lenses 40*a*, 40*b* and 40*c* each have an exit surface 45 through which the light exits the lenses. In the illustrated embodiment each lobe 12*a*, 12*b* and 12*c* comprises a lens 40*a*, 40*b* and 40*c* arranged such that one lens corresponds to and is arranged in line with one of the LED light sources 24. The TIR optical element 12 and the heat sink 14 do not have to be provided with a lobed configuration provided that the lenses 40*a*, 40*b* and 40*c* are provided on the TIR optical element in a one-to-one corresponding relationship to the LED light sources 24. The lenses 40*a*, 40*b* and 40*c* also includes recessed, curved entrance surfaces 42 that receive light from one of the LED light sources 24 and that transmit light to the corresponding exit surfaces 45 of lenses 40*a*, 40*b* and 40*c*. While a single TIR optical element is shown, multiple TIR elements may be used.

Figure 6:
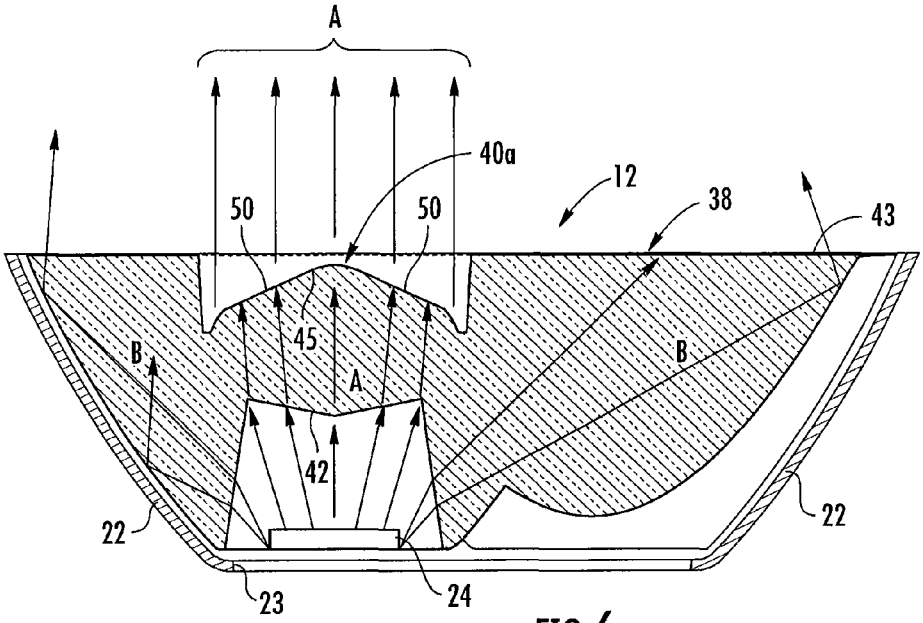
FIG. 6 is a side section view corresponding to the perspective section view of the TIR optical element of FIG. 4 showing the light paths through the TIR optical element.

Light from the LED light source is directed as shown in FIG. 6 where one lens 40*a*, having an entry surface 42, an exit surface 45 and surrounding portion of the TIR optical element 12, is shown. Each of the lenses 40*a*, 40*b* and 40*c* operates in substantially an identical manner such that specific reference will be made to lens 40*a*. A portion of the light A from light source 24 is emitted directly into the entrance surface 42, exits from exit surface 45 and is focused by the lens 40*a* to create a beam of collimated light. A further portion of the light B is directed onto the TIR surface of the TIR optical element 12 where it is reflected toward exit surface 38. The light may exit from the microlens 43. The microlens 43 mixes the light and disperses the light to overlap with the light exiting from lenses 40*a*-40*c*. Light that escapes from the TIR optical element 12 may be reflected back into the TIR optical element by secondary reflector 22 where it also may exit through the microlens 43 and lens 40*a*. Typically, the angular distribution of light emitted from an LED light source is close to Lambertian, which has Full Width at Half Maximum (FWHM) beam angle of 120 degrees. The TIR optical element 12 as described herein may be used in directional lighting to collimate the light at a narrow beam angle such as between 12 and 60 degrees.

The lenses 40*a*, 40*b* and 40*c* are formed as faceted domed lenses to disperse the light in a manner that mixes the light and eliminates dark spots in the projected light. Round dome lenses are known for collimating light in directional lighting applications. One problem with round dome lenses is that the light projected from a plurality of LED chips may show up as distinct light areas separated by darker areas. For example, in a system that uses four LED chips light may be projected as four relatively distinct squares of light separated by darker, unlit lines. The faceted lenses 40*a*, 40*b*, 40*c* better mix light exiting the lamp and eliminate the dark spots or lines to create a more uniform, better shaped beam.

Figure 11:
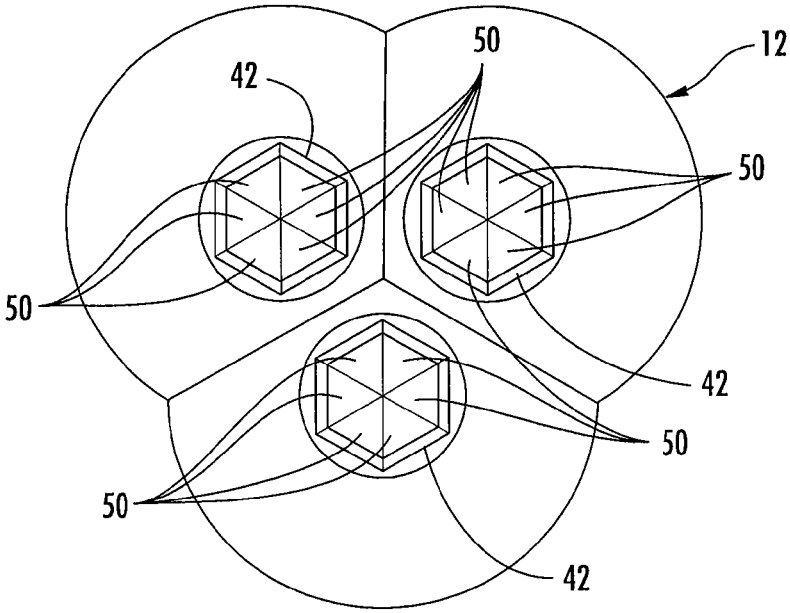
FIG. 11 is a back view of an alternate embodiment the TIR optical element.

Each faceted lens 40*a*, 40*b*, 40*c* includes a plurality of facets 50 on the entrance surface 42 and/or exit surface 45 that are disposed relative to the LED light sources 24 such that light from each light source 24 is mixed with light from other ones of the light sources 24. The facets 50 are disposed such that they are asymmetrically arranged with respect to the associated LED light source 24 such that the light from each of the light sources is dispersed in an asymmetrical manner. The facets 50 are arranged such that the lenses collimate the light beam. Each facet 50 may be a planar surface or the facets may be slightly convex or concave in shape. In the embodiment of FIGS. 1-6 the facets 50 are formed on the exit surfaces 45. In FIG. 11 the facets 50 are formed on the entrance surfaces 42. The facets may be provided on either the entrance surfaces 42 of the lenses 40*a*, 40*b*, 40*c* or the exit surfaces 45 of the lenses 40*a*, 40*b*, 40*c*. Moreover, both the exit surfaces and the entrance surfaces of each of the lenses 40*a*, 40*b*, 40*c* may be faceted as will be explained.

Figure 7:
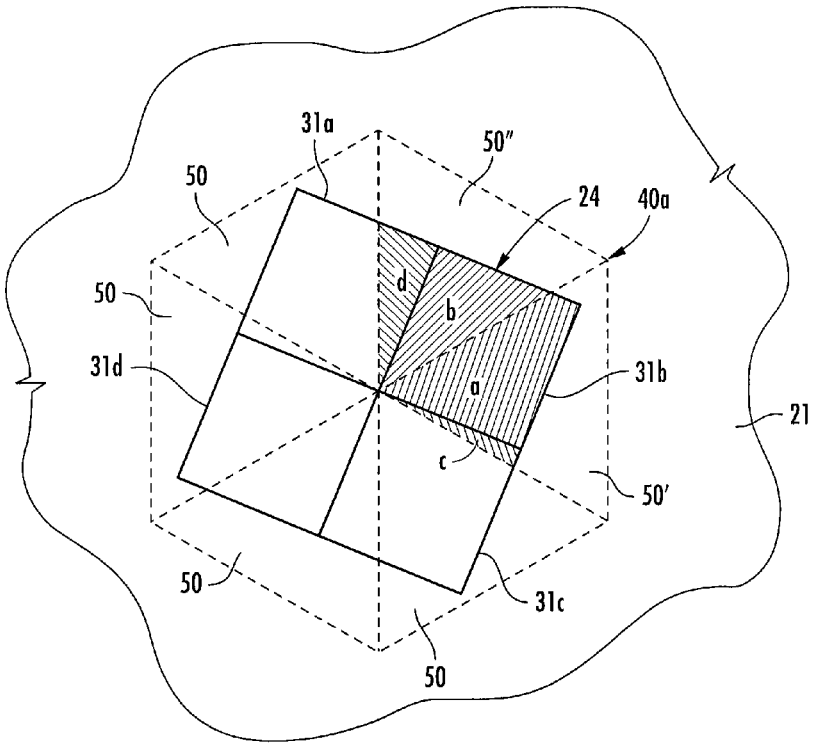
FIG. 7 is a diagram showing the relationship between an embodiment of the TIR optical element and the LED chip or die.
Figure 8A:
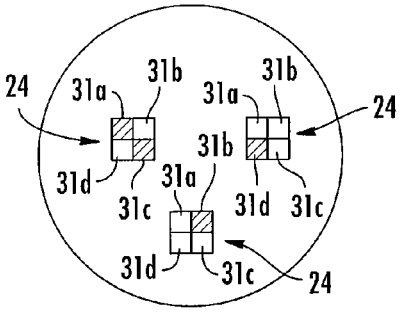
FIGS. 8A-8D show example embodiments of three LED light sources where each light source includes four LED chips.
Figure 8B:
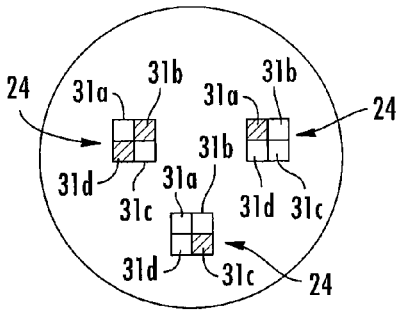
Figure 8C:
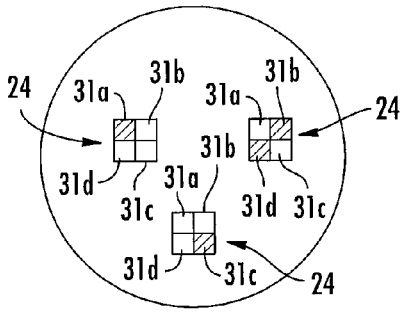
Figure 8D:
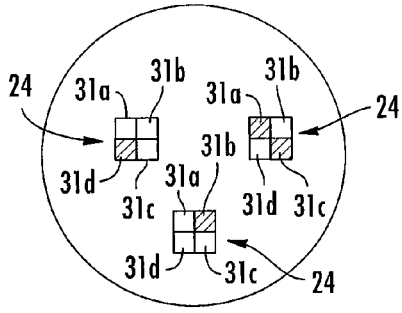

An example arrangement of one light source and a faceted dome lens is shown diagrammatically in FIG. 7. One LED light source 24 is shown having four LED chips 31*a*-31*d* where the chips may emit different color light as previously described. A faceted lens 40*a* is shown overlayed on the LED light source 24 to illustrate the arrangement of the facets 50 relative to the LED chips 31*a*-31*d*. In the illustrated embodiment six facets 50 are provided on one lens 40*a* where the six facets 50 are arranged relative to the LED chips 31*a*-31*d* and divide the light projected by the LED light source 24 asymmetrically. For example, a major portion of the light from LED chip 31*b* (shaded area a) is directed through facet 50' while a second smaller or minor portion of the light from the same LED chip 31*b* (shaded area b) is directed through facet 50". A relatively small or minor portion of the light from LED chip 31*c* (shaded area c) is directed through facet 50' and mixed with the major portion of the light from chip 31*b*. The minor portion, shaded area b, of the light from LED chip 31*b* directed through facet 50" and mixed with a minor portion of the light from LED chip 31*a* (shaded area d). The same relationship is true for each of the LED chips where a portion of the light from each LED chip passes through at least two different facets. Mixing of light for all of the LED chips 31*a*-31*d* occurs at each facet 50. Because the facets 50 are disposed at varying angles relative to the light beam, light directed through each facet 50 is projected at a slightly different angle as the light projected through any other facet. The facets enhance mixing of light and may be used where the adjacent chips project light of the same color and/or light of a different color. The light from the different chips 31*a*-31*d* directed through the facets 50 is mixed upon exiting the TIR optical element 12 and the projected dark and light spots found with round dome lenses are eliminated to create a better mixed and shaped uniform beam of light. The actual angular relationship of the light source 24 and the faceted lens may vary from that shown in the figures.

In the illustrated embodiment six facets 50 are used with four LED chips 31*a*-31*d* because the six equally dimensioned and shaped facets 50 asymmetrically divide the light projected from the four LED chips 31*a*-31*d*. If four or eight facets of equal size and shape were used, the light from the four LED chips would be symmetrically divided and the resultant light mixing would not be obtained. However, some mixing benefit would be obtained if four or eight facets were used with four LED chips if the facets were asymmetrically related to one another and to the chips such as by making each facet of a different size and shape. The number of facets used on each lens is dependent on the number of chips in each light source and is determined such that an asymmetrical relationship is established between the facets and the chips. In one embodiment the number of facets is selected such that it is not evenly divisible by the number of LED chips. Moreover, the number of facets is selected so as to be as far from an evenly divisible number as possible. For example, in the illustrated example with four LED chips both four (facets) and eight (facets) are divisible by 4 (the number of LED chips) while six (facets) is not divisible by four (the number of LED chips). Thus, six facets provides the desired asymmetrical relationship between the facets and LED chips. While five (facets) and seven (facets) are also not divisible by four, both five and seven are closer to the divisible numbers four and eight than is six. Therefore, six facets will provide better light mixing than either four, five, seven or eight facets. Where more or less than four chips are used in the LED light source the number of facets will likewise vary to provide the asymmetric relationship between the chips and the facets.

Figure 9:
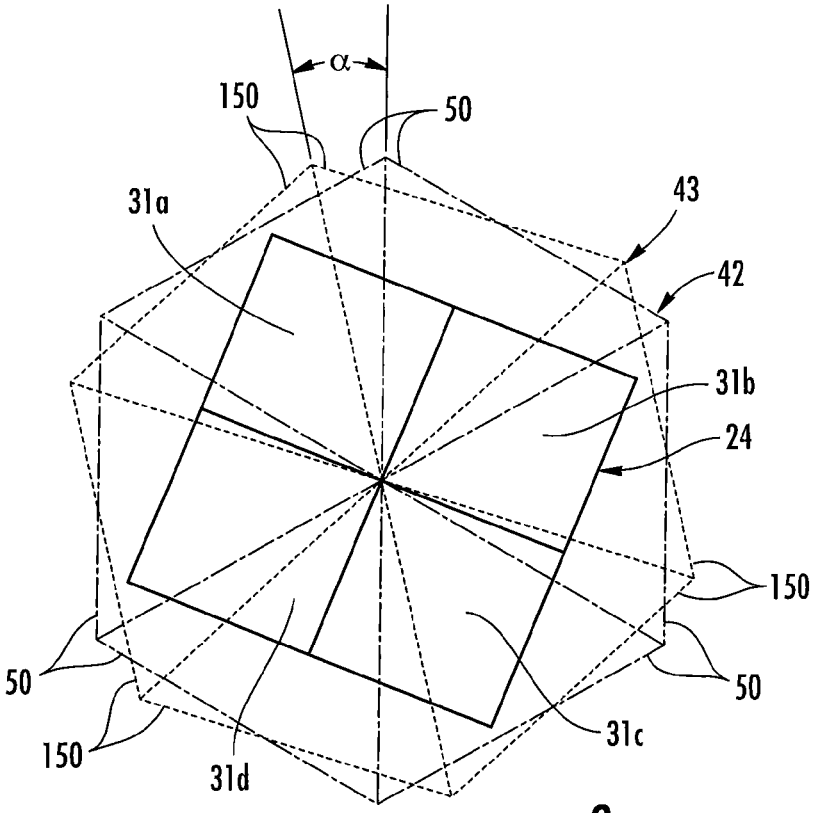
FIG. 9 is a diagram showing the relationship between an alternate embodiment of the TIR optical element and the LED chip or die.

Referring to FIG. 9 an example arrangement of one light source 24 and a faceted dome lens is shown diagrammatically where both the entrance surface 42 and the exit surface 43 of the same lens are faceted. In such an arrangement the entrance surface 42 may be angularly offset relative to the exit surface 43 by an angle α such that the facets 50 of the entrance surface 42 are angularly offset relative to the facets 150 of the exit surface 45. Alternatively, the entrance surface 42 may be provided with a different number of facets 150 than the number of facets 50 and the number of LED chips. In the illustrated example five facets 50 of the entrance surface 42 may be used in combination with the six facets 150 of the exit surface 45 and the four LED chips 31*a*-31*d*. In one embodiment the angular offset α between the entrance surface 42 and the exit surface 43 is between 20 and 30 degrees. The faceting of both the entrance and exit surfaces enhances mixing of the light as shown where the light from each of LED chips 31*a*-31*d* is mixed by the entrance surface 42 and the exit surface 45 in an asymmetric manner. Each faceted surface is asymmetrically related to the light source 24 and the faceted surfaces are angularly offset relative to one another.

Figure 10:
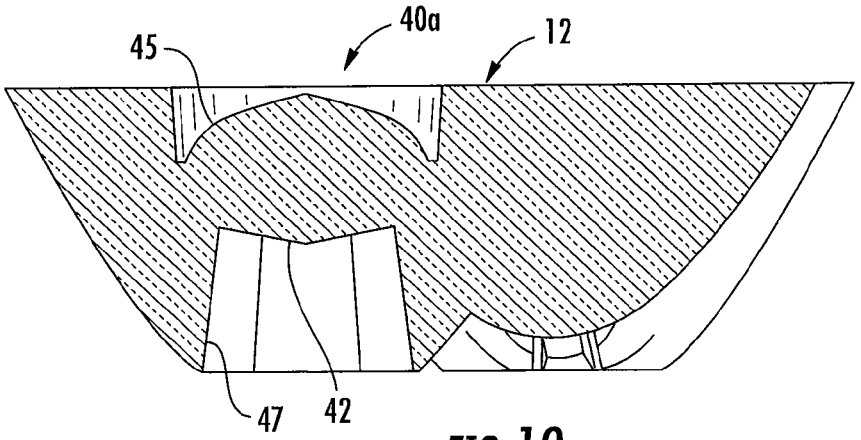
FIG. 10 is a section view similar to FIG. 6 showing an alternate embodiment of the TIR optical element.

In addition to faceting the entrance surfaces 42 and exit surfaces 45 of the lenses 40*a*, 40*b*, 40*c*, the interior surface 47 of the body of the optical element 12 that surrounds the light source 24 and that leads to the entrance surface 42 of the lens may also be faceted as shown in FIG. 10. The faceting of surface 42 enhances the mixing of the light that exits the TIR optical element 12 through the microlens 43.

Embodiments of the invention can use varied fastening methods and mechanisms for interconnecting the parts of the lighting system and luminaire. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An optical arrangement for a solid-state lighting system, the optical arrangement comprising:

an optical element comprising an exit surface, the exit surface comprising a first lens and a second lens where the first lens is spaced from the second lens on the exit surface by a second type of exit surface, the first lens having a first faceted surface defining a plurality of first facets and the second lens having a second faceted surface defining a plurality of second facets; and a first LED light source comprising a first plurality of LED chips and a second LED light source comprising a second plurality of LED chips, the first plurality of LED chips arranged relative to the first lens such that the plurality of first facets are rotationally asymmetrical relative to the first plurality of LED chips such that light from the first plurality of LED chips is mixed by the first faceted surface and the second plurality of LED chips arranged relative to the second lens such that the plurality of second facets are rotationally asymmetrical relative to the second plurality of LED chips such that light from the second plurality of LED chips is mixed by the second faceted surface.

2. The optical arrangement of claim 1 wherein the optical element is a TIR optical element.

3. The optical arrangement of claim 1 wherein the first LED light source comprises four LED chips.

4. The optical arrangement of claim 3 wherein the first faceted surface comprises six facets.

5. The optical arrangement of claim 1 wherein at least one of the first plurality of LED chips comprises a red-emitting LED.

6. The optical arrangement of claim 5 wherein at least one of the first plurality of LED chips comprises a blue-shifted yellow LED device.

7. The optical arrangement of claim 6 wherein the blue-shifted yellow LED device is packaged with a local phosphor.

8. The optical arrangement of claim 6 wherein the blue-shifted yellow LED device plus the red-emitting LED create substantially white light.

9. The optical arrangement of claim 1 wherein the second type of exit surface comprises a flat substrate with a micro-lens.

10. The optical arrangement of claim 1 further comprising an entrance surface associated with the first lens where the entrance surface comprises a second plurality of facets.

11. The optical arrangement of claim 1 wherein the first facets and the second facets are planar surfaces.

12. The optical arrangement of claim 1 wherein a first light from one of the first plurality of LED chips passes through one of the plurality of first facets and a second light from another one of the first plurality of LED chips passes through said one of the plurality of first facets.

13. The optical arrangement of claim 12 wherein the first light from one of the first plurality of LED chips is a first color and the second light from another one of the first plurality of LED chips is a second color.

14. The optical arrangement of claim 12 wherein a first amount of the first light from one of the first plurality of LED chips passes through said one of the plurality of first facets and a second amount of the second light from another one of the first plurality of LED chips passes through said one of the plurality of first facets where the first amount is less than the second amount.

15. The optical arrangement of claim 12 wherein an interior surface of the optical element that surrounds the first LED light source is faceted.

16. An LED lighting system comprising:

an optical element having an exit surface comprising a plurality of lenses, the plurality of lenses each having a faceted surface defining a plurality of facets; and a plurality of LED light sources each comprising a plurality of LED chips, the plurality of LED light sources being arranged in a one to one relationship with the plurality of lenses such that one of the plurality of LED light sources is arranged relative to the faceted surface of one of the plurality of lenses such that the plurality of facets are rotationally asymmetrical relative to the plurality of LED chips such that mixing of light from the plurality of LED chips occurs at the exit surface.

17. The lamp of claim 16 wherein the optical element is a TIR optical element.

18. The lamp of claim 16 wherein the plurality of light sources are arranged in an array where each of said plurality of light sources comprise a plurality of LED chips wherein the plurality of LED chips comprises a first type of chip for emitting a first color light and a second type of chip for emitting a second color of light.

19. The lamp of claim 16 further having a connector of a standard, MR-16 lamp.

20. A method of assembling a lighting system, the method comprising:

arranging a plurality of LED light sources in an array within a housing where each of the plurality of light sources comprises a plurality of LED chips;

placing at least one optical element to receive and direct light from the plurality of LED light sources where the optical element comprises an exit surface, the exit surface comprising a plurality of lenses, each of the plurality of lenses having a faceted surface defining a plurality of facets; and arranging the at least one optical element relative to the array such that the plurality of facets of each of the plurality of lenses are rotationally asymmetrical relative to the plurality of LED chips of each of the plurality of LED light sources such that one of the plurality of lenses receives light from one of the plurality of LED light sources.

21. The method of claim 20 wherein the at least one optical element is at least one TIR optical element.

22. The method of claim 20 wherein the lamp has a form factor of a standard, MR-16 halogen lamp.

23. An LED lighting system comprising:

an optical element comprising an exit surface, the exit surface comprising a plurality of lenses, the plurality of lenses each having a faceted entrance surface defining a plurality of facets; and a plurality of LED light sources each comprising a plurality of LED chips, the plurality of LED light sources arranged in a one to one relationship with the plurality of lenses such that one of the plurality of LED light sources is arranged relative to the faceted surface of one of the plurality of lenses such that the plurality of facets are rotationally asymmetrical relative to the plurality of LED chips such that light from the plurality of LED chips is mixed.

24. An optical arrangement for a solid-state lighting system, the optical arrangement comprising:

an optical element comprising an exit surface, the exit surface comprising a first lens and a second lens where the first lens is spaced from the second lens, the first lens having a first faceted surface defining a plurality of first facets and the second lens having a second faceted surface defining a plurality of second facets; and a first LED light source for generating substantially white light comprising a first LED chip and a second LED light source for generating substantially white light comprising a second LED chip, the first and second LED light sources arranged relative to the first and second faceted surfaces such that the plurality of facets of the first lens are rotationally asymmetrical relative to the first LED chip such that a major portion of the light from the first LED chip enters one of the plurality of first facets and a minor portion of the light from the first LED chip enters another one of the plurality of first facets and the plurality of facets of the second lens are rotationally asymmetrical relative to the second LED chip such that a major portion of the light from the second LED chip enters one of the plurality of second facets and a minor portion of the light from the second LED chip enters another one of the plurality of second facets.

* * * * *